United States Patent [19]

Carter et al.

[11] Patent Number: 4,936,086

[45] Date of Patent: Jun. 26, 1990

[54] APPARATUS FOR STRIPPING YARN ENDS FROM SPINDLES

[75] Inventors: Jerry T. Carter, Charlotte; Edgar A. Pace, Winston Salem, both of N.C.

[73] Assignee: Flakt, Inc., Charlotte, N.C.

[21] Appl. No.: 469,923

[22] Filed: Jan. 25, 1990

[51] Int. Cl.[5] ..... D01H 11/00; B65H 73/00; B08B 5/00

[52] U.S. Cl. ..... 57/304; 15/312 A; 15/319; 28/295; 57/305; 57/306

[58] Field of Search ..... 57/300–302, 57/304–307; 15/300 R, 312 R, 312 A, 319, 345; 28/292–295

[56] References Cited

U.S. PATENT DOCUMENTS

| | | | |
|---|---|---|---|
| 3,426,518 | 2/1969 | Winter et al. | 57/306 |
| 3,579,761 | 5/1971 | Plonsker et al. | 57/306 X |
| 3,726,072 | 4/1973 | Ford et al. | 57/304 X |
| 3,779,003 | 12/1973 | Boissevain et al. | 59/78.1 |
| 3,813,865 | 6/1974 | Hohloch | 57/305 |
| 3,913,190 | 10/1975 | Savageau et al. | 28/294 |
| 4,121,318 | 10/1978 | Jacobi | 15/312 A |
| 4,133,168 | 1/1979 | Keller, Jr. et al. | 57/304 |
| 4,208,865 | 6/1980 | Koella | 57/303 |
| 4,263,776 | 4/1981 | Lane | 57/304 X |
| 4,283,909 | 8/1981 | Keller et al. | 57/306 |
| 4,342,130 | 8/1982 | Clark et al. | 15/312 A |
| 4,484,434 | 11/1984 | Rummele | 57/304 |

FOREIGN PATENT DOCUMENTS

DE35037-55A1 8/1986 Fed. Rep. of Germany .

*Primary Examiner*—John Petrakes

[57] ABSTRACT

Apparatus for use with a traveling cleaner for textile machines, particularly ring spinners, operable to strip yarn ends from the whirls of the spindles for the bobbins of the ring spinner apparatus. A whirl cleaner blade is pivoted to the frame of the ring spinner adjacent each spindle so that its free blade end may be displaced into engagement with the whirl of the spindle by a jet of compressed air impinged against the blade. The compressed air is supplied by a nozzle suspended from the carriage of the pneumatic cleaner to impinge against the blade. The compressed air is fed from a central junction box under the track for the carriage through the energy chain which houses the power supply cables for the carriage. From the carriage, the compressed air is piped to the nozzle positioned at the level of the spindle whirls. Control means is provided to activate the flow of compressed air for a selected time period which achieves stripping of the whirls of all of the spindles in the apparatus during the time when the ring rail is disposed a distance above the spindle whirls. In installations where the pneumatic cleaner additionally services sections of textile machinery which do not have spindles needing stripping, the flow of compressed air is also controlled by the travel of the cleaner between sections.

10 Claims, 4 Drawing Sheets

APPARATUS FOR STRIPPING YARN ENDS FROM SPINDLES

FIELD OF THE INVENTION

The present invention relates to textile machinery and has particular application to pneumatic cleaners for use with ring spinners.

BACKGROUND OF THE INVENTION

In a ring-spinning frame, the yarn is supplied in the form of packages of roving which is drafted and spun into yarn as it is wound onto bobbins which are mounted on spindles for rotation about a vertical axis. The roving from the packages passes through drafting rolls and yarn guides to a traveler ring which orbits the bobbin and traverses the length of the bobbin to build a compact package of spun yarn on the bobbin. The traveler is carried by the ring rail which normally builds the package starting at the bottom and traverses upwardly.

The spindles have an area immediately below the bobbins, referred to as the whirl, onto which several wraps of yarn are wound as the ring rail traverses down below the bobbin prior to stopping the frame for doffing of the full yarn bobbins. This assures that as the full bobbins are doffed, the yarn remains threaded up from the drafting rolls through the yarn guide and traveler to the spindle. Removing the full bobbins separates the yarn between the bobbin and the spindle whirl, leaving several wraps of yarn on the whirls. After empty bobbins are placed onto the spindles and the frame is restarted, a few more wraps are added to the whirl before the ring rail is raised to its normal operating position where the yarn is wound onto the empty bobbins.

Unless the wraps of yarn are removed from the whirl, with each doff a few more wraps of yarn are added to each spindle whirl, and pieces of yarn and fibers will eventually be thrown from the spindle whirls and may get into the rings, travelers and yarn being processed. This can result in yarn defects and may even cause the yarn to break. Through the years there have been many different attempts to provide devices to efficiently remove the wraps of yarn from spindle whirls. Machine operators have used brushes, various abrasive materials and rotating discs to press against the rotating spindle whirls, thus tearing the yarn from the whirl. This tended to be slow and if not done at frequent intervals, resulted in large quantities of fiber and yarn pieces being thrown about. Variations of these approaches included adding a vacuum source to collect the fiber and yarn pieces removed from the whirl, but it still required required a person to operate it.

More recently, blade-like devices have been mounted adjacent the base of each spindle. Each blade has a flat target area arranged so that a stream of air directed against the blade assembly at right angles to the side of the frame causes the end edges of the blade to move against the spindle whirl, impinging the yarn wraps and causing them to break up and be thrown off. Manufacturers of traveling blowing and suction machines for ring spinning frames have provided special blowing outlets to actuate these whirl-cleaning devices. Such blowing outlets use the same relatively low pressure exhaust air that is used for cleaning the frames. In some installations, the blowing outlets blow continuously, thus activating the whirl-cleaning blades every time the traveling cleaner device passes, as frequently as every 4 to 15 minutes. Not only does this continuously divert exhaust air from cleaning other parts of the spinning frame, but such frequency is unnecessary and accelerates the wear on the whirlcleaning blades. In other installations, the blowing outlets are equipped with dampering devices and complex control systems so that the whirl-cleaning blades are actuated only when needed, once after each doff.

At least one spinning frame manufacturer provides relay contacts which are controlled by the builder motion for the ring rail of the spinning frame. The contacts are actuated several minutes after the start of a spinning cycle when the ring rail is operating near the top of the bobbins, farthest from the spindle whirls to initate mechanical or optical signals which, in turn, actuate dampering mechanism in the exhaust air supply to the whirl-cleaning outlets of the traveling cleaner. In such a case, the entire flow of exhaust is diverted to operate the cleaning blades and is lost for cleaning other parts of the spinning frame during actuation of the dampering mechanism.

SUMMARY OF THE INVENTION

The present invention provides an attachment for pneumatic cleaning machines which operates efficiently and effectively to strip the yarn ends from the spindle whirls in textile machinery, without substantially modifying the textile machinery itself.

More specifically, the present invention provides an arrangement for use with spinning frame in which the pneumatic cleaner carriage is self-propelled and is supplied with power through an energy chain interconnecting the carriage with a central control box adjacent the trackway for the carriage, the flexible energy chain providing a housing for a conduit for connecting a source of compressed air to the carriage, the invention utilizing the compressed air to operate whirl-cleaning blades in an efficient and effective manner.

More specifically, the present invention provides a cleaning device in which the controls for controlling the flow of compressed air through the carriage to the blades are disposed within a central control box, avoiding the need for dampers, valves or such controls in the traveling cleaner unit.

The invention is also applicable to textile machines having multiple sections in which the spinning of yarn onto bobbins is effected in only one section, the invention providing means for inactivating the supply of compressed air to the cleaning device when the device passes out of registry with the spinning section.

The present invention provides a cleaning apparatus which is cost-effective, reliable in operation, and simple and easy to operate and maintain.

BRIEF DESCRIPTION OF THE DRAWINGS

All of the objects of the invention are more fully set forth hereinafter with reference to the accompanying drawings, wherein.

DESCRIPTION OF THE PREFERRED EMBODIMENTS

Figure 1:
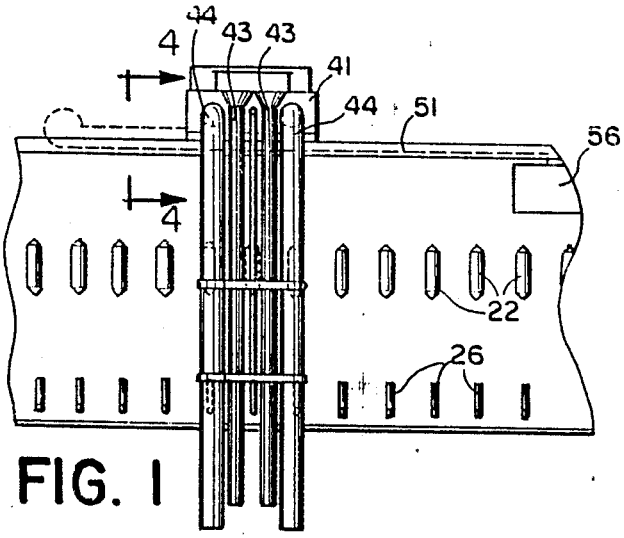
FIG. 1 is a schematic fragmentary front view of the spinning section of a textile machine showing the pneumatic cleaner carriage in position thereon.

Referring to FIG. 1, the invention is applicable to a textile machine in at least one section of which there is a ring-spinning frame in which there is a creel 21 for supporting a plurality of packages 22 of roving or the like. The roving from the packages 22 is passed through appropriate yarn-handling devices including draw rolls, yarn guides, etc. (not illustrated) and finally through the traveler 25 of a ring spinner mounted for orbiting around a bobbin 26 mounted on a spindle 27 rotatable in a bearing 28 in the spindle rail 29. The traveler 25 is guided by a ring 32 mounted on the ring rail 33 which traverses the length of the bobbin, controlled, for example, by a builder cam 34 (see FIG. 5). In operation, the roving from the packages 22 is drafted and spun into yarns housing the desired properties as the yarn is wound onto bobbins 26.

Figure 2:
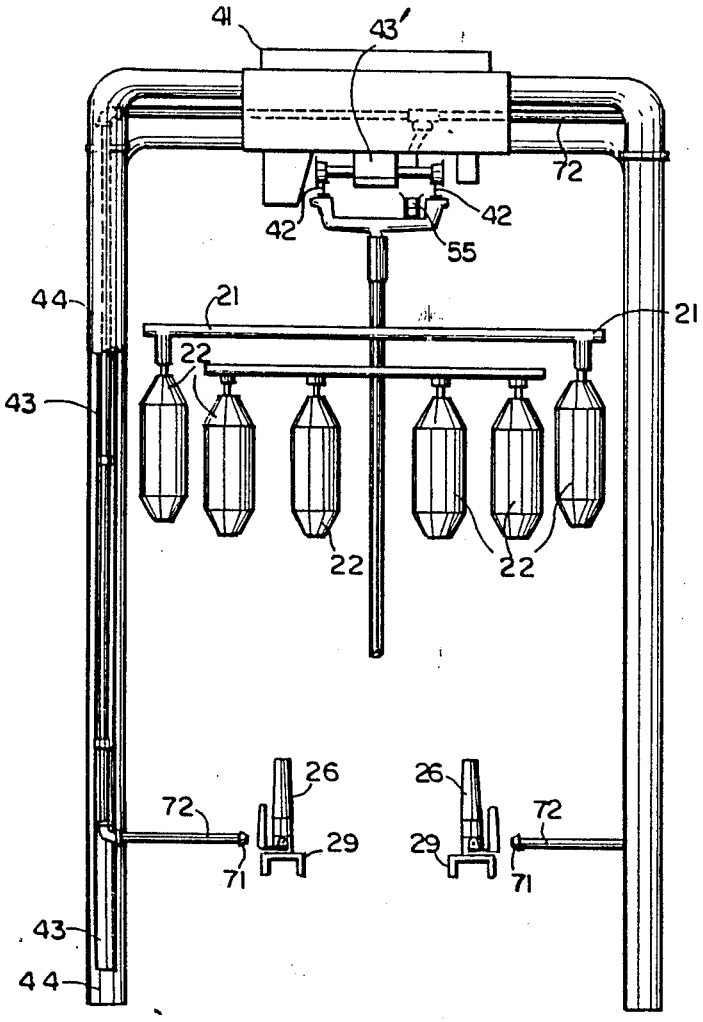
FIG. 2 is a schematic transverse sectional view through the apparatus shown in FIG. 1.

The operation of the spinning frame produces a substantial quantity of lint, dust and other particulate matter which is airborne and deposited on mechanisms in the vicinity of the machine and, to this end, a traveling cleaner is provided to remove the particulate matter from the vicinity of the spinning frame. As shown in FIGS. 1 and 2, the cleaner comprises a carriage 41 mounted for movement along a pair of tracks 42,42 along the top of the frame. The carriage is self-propelled by suitable drive means 43 and carries suction/exhaust means to generate an outward flow of cleaning air through depending exhaust tubes 43,43 and an inward flow of vacuum air through vacuum tubes 44,44. In the drawings, the vacuum and exhaust tubes are arranged in pairs on opposite sides of the centerline of the carriage so that as the carriage travels along the length of textile machine, both sides of the machine are exposed to the cleaning air from the exhaust tubes 43 and for takeup from the vacuum tubes 44 twice in each pass of the carriage along the length of the machine. The tubes 43 and 44 have ports (not shown) for directing the outward and inward flows of air to those portions of the machine and the surrounding floor area where the dust and lint would otherwise accumulate.

If desired, the lower parts of the vacuum tubes 44 may be offset inwardly to be positioned in close proximity to the lower operating parts of the spinning frame during the cleaning operation. The cleaning device is normally positioned out of the way during the doffing operation, so that there is no interference between the cleaning devices and the doffing mechanism. The tubes are sufficiently flexible so that they do not obstruct the travel of the carriage when they encounter obstacles or personnel who may be in the path of travel of the tubes.

The suction/exhaust means in the carriage includes suitable filtration apparatus to separate the particulate matter from the suction air before it is recirculated to the spinning frame as exhaust air, and the filtration apparatus is normally cleared of particulate matter periodically at one end or the other of the travel of the apparatus along the textile machine.

Figure 4:
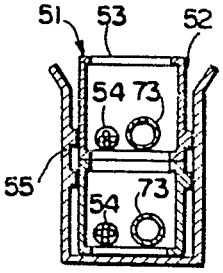
FIG. 4 is a sectional view taken on the line 4—4 of FIG. 1 showing the energy chain.

The power to the carriage drive and the suction/exhaust means is supplied to the carriage 41 through an energy chain 51. The energy chain 51 comprises a series of pivotally-connected links, each consisting of sidewalls 52 having cross pieces 53 therebetween to form an open-ended channel for the reception of power lines 54 (see FIG. 4). The links are guided in a trough-like guide 55 which extends along the length of the machinery beneath the tracks 42. As indicated by the broken lines in FIG. 1, one end of the energy chain 51 is connected to a junction box 56 which is preferably positioned centrally between the opposite ends of the tracks 42,42. The length of the energy chain 51 is sufficient to enable the carriage to travel from one end of the track to the other without breaking the connection to the energy chain. When the energy chain is fully extended at the end of the run of the carriage, the chain is disposed at the bottom of the trough, and as the carriage returns, the chain has a reverse bend and travels in the trough in a second run overlying the first run until it passes the junction box 56. The compartments of the links are sufficiently large to accommodate several cables or other power supply conduits.

Figure 3:
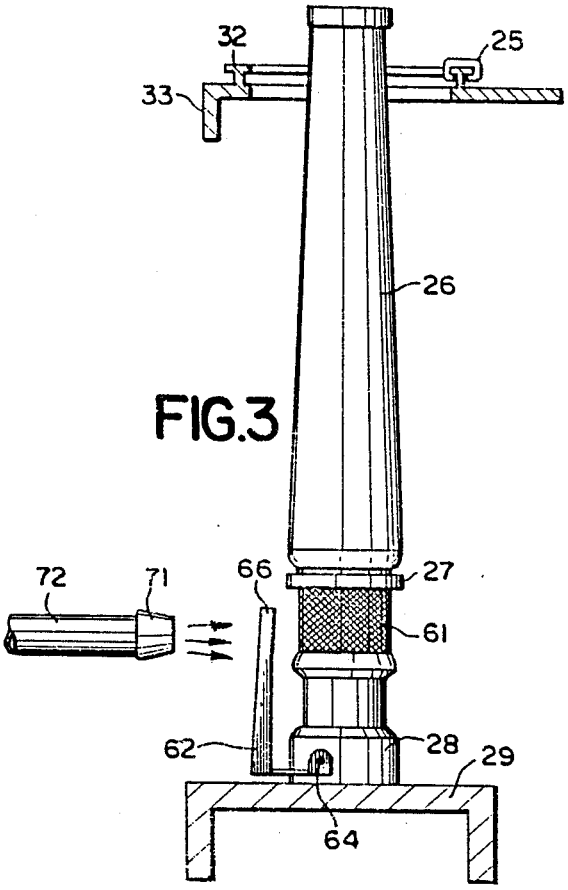
FIG. 3 is an enlarged transverse section through a spindle of the apparatus shown in FIG. 1.

During operation of the spinning frame, the roving is twisted into yarn as it is wound around the bobbins 26, and the ring rail 33 is traversed along the length of the bobbin. At the completion of the package on the bobbin 26, the ring rail is lowered to a position below the bottom of the bobbin 26 so that the yarn is wound around the whirl 61 which is a friction surface formed on the spindle immediately below the bobbin. The whirl surface extends circumferentially of the spindle as shown in FIG. 3 so that when the ring rail is lowered, the yarn is wound about the whirl surface with several turns before the spinning frame is arrested for the doffing operation. In the doffing operation, the doffing apparatus (not shown) doffs the full bobbins 26 and replaces them with empty bobbins 26. At the completion of the doffing cycle, the machine is restarted while the ring rail 33 is at its lower position so that additional turns of yarn are wound on the whirl 61 before the ring frame is raised into registry with the now-empty bobbins 26 for starting the new packages. The packages are built from the bottom up as the ring rail is elevated.

Figure 6:
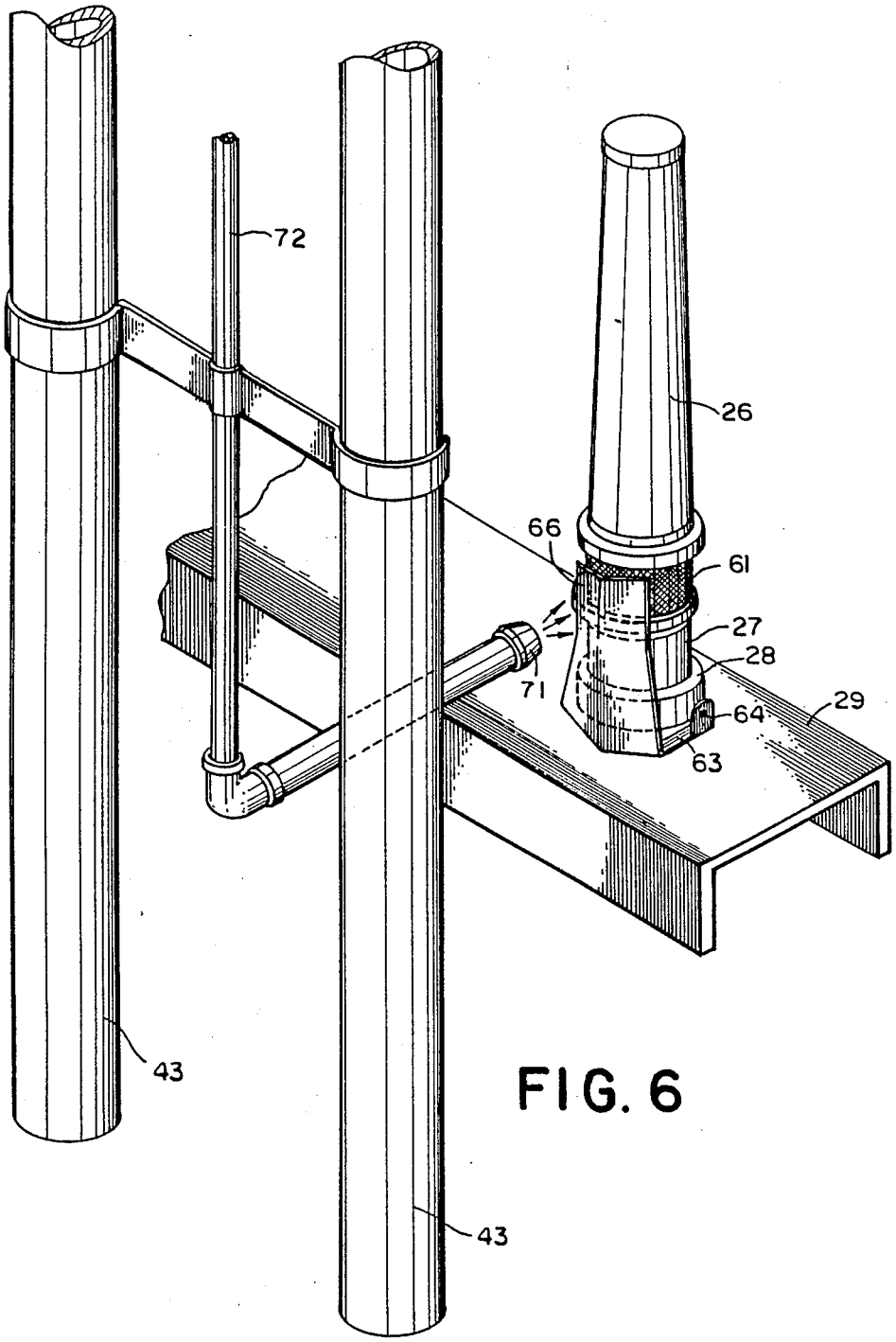
FIG. 6 is a perspective view illustrating the operation of nozzles and blades for stripping the spindles.

In order to strip the turns of yarn accumulated on the whirls 61 during the doff and immediately before and after, a cleaner blade 62 is provided on the spindle rail 29. The blade 62, as shown in FIGS. 3 and 6, is disposed upright generally parallel to the axis of the spindle and has a pair of support legs 63 which extend toward the axis of the spindle 27 and are pivotally mounted on the spindle rail 29 as indicated at 64. When the spindle blade is pressed inwardly, the upright part of the cleaner blade pivots inwardly on the pivots 64 so that the free upper end 66 bears against the whirl 61 and operates to strip the whirl of the turns of yarn which have been wound thereon. So far as described to this point, the spinning frame structure is substantially conventional, and the operation represents the operating standard in the industry at the present time.

Prior to the present invention, the cleaner blades 62 have been actuated by providing an outlet in the exhaust tubes 43 at a level which registers with the spindle blades 62 so as to blow exhaust air against the top of the cleaner blades 62 and cause engagement of the free end 66 with the whirl. In order that the exhaust air in the tubes 43 provides sufficient force to effect pivotal displacement of the blades, it was usual to interrupt all of the discharges through the exhaust tubes 43 and divert the entire flow from the suction/exhaust means through the single port for deflecting the blade end 66 against the whirl 61, and frequently the force was still insufficient to effect complete stripping of the whirl by the blade end. Furthermore, the controls in the carriage and the exhaust tubes to achieve the concentration of flow necessary to displace the spindle blade with the exhaust air was expensive and subject to severe operating conditions which rendered maintenance and continued operation difficult. Although this manner of displacement of the cleaner blades has been used extensively, the present invention is believed to overcome the difficulties encountered in such operation and provide a novel mode of operation, which is both efficient and effective.

In accordance with the present invention, a separate supply of compressed air is utilized to actuate the cleaner blade, thereby avoiding the need to divert exhaust air from its primary function of cleaning the mechanisms in the vicinity of the spinning frame. As shown in the drawings, a separate nozzle 71 is suspended from the carriage 41 and is disposed to discharge a jet of compressed air against the cleaner blade at a sufficient height above the pivots 64 to displace the free end 66 of the blade into engagement with the whirl 61. Thus, as the carriage travels along the tracks 42,42 along the length of the spinning frame, the nozzle passes into registry with the upright cleaning blades as it enters each spinning station. Continued travel of the carriage causes the nozzle to pass out of registry with the blade in one spinning station and travel into registry with the blade in the next spinning station.

In the illustrated embodiment of the invention, the nozzle 71 is mounted on a pipe 72 which is supported between the exhaust tubes 43. The pipe 72 extends into the carriage 41 and is connected within the carriage to a flexible conduit 73 which extends within the energy chain 51 alongside the power conduit 54. The flexible compressed air conduit 73 is connected to a supply of compressed air in the junction box 56 which includes a suitable controller including, for example, a shut-off valve 77. The source of compressed air to the junction box 56 includes a connection to the compressed air supply which is conventional in textile mills to which the invention is particularly applicable. Thus, the present invention enables the whirl cleaner to be operated by utilizing a stationary source of compressed air at 78 without dampers, valves, or electropneumatic controls in the traveling cleaner unit without need for diverting the flow of exhaust air from the exhaust air tubes 43.

Figure 5:
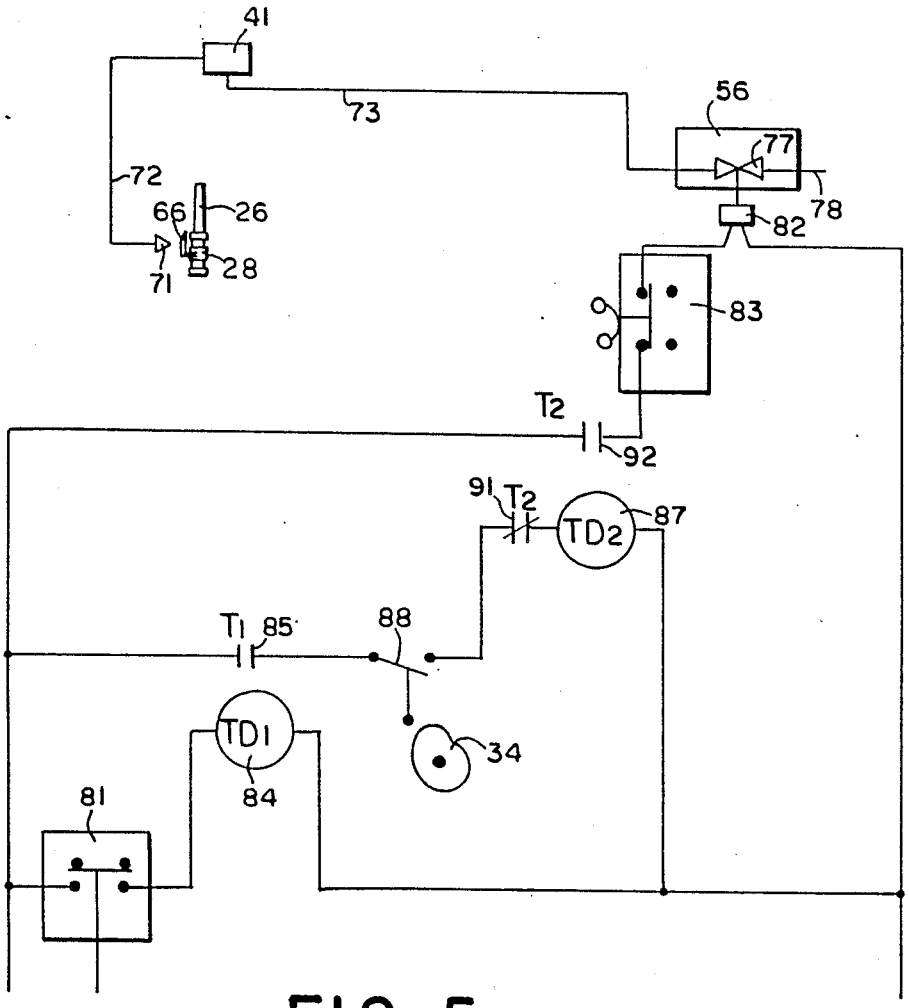
FIG. 5 is a circuit diagram showing controls for the compressed air supply.

The flow of compressed air to the nozzles 71 is controlled through electronic controls in the junction box responsive to actuation from the standard controls for the spinning frame, namely the builder cam motion 34 and a switch 81 responsive to the starting and stopping of the spinning frame in preparation for and subsequent to the doffing operation. As shown in FIG. 5, the compressed air valve 77, which enables flow of compressed air through the flexible conduit 73 and the pipe 72 to the nozzle 71, is operated by a solenoid 82 which is energized for a preset time period following a predetermined delay after the spinning frame is restarted following a doff. For those installations where the cleaner carriage 41 traverses multiple-section machines in which only one section is a spinning frame, an additional switch 83, which is responsive to the position of the carriage on the track, is utilized to disable the solenoid valve 82/77 during the interval when the carriage is beyond the spinning frame section of the textile machinery.

Referring to FIG. 5, the control circuit for the solenoid 82 for the valve 77 is illustrated. The switch 81 is closed during the interval when the spinning frame is operating between doffs, and is open during the doff. To this end, the switch 81 is connected in series with a time-delay device 84 having a normally open switch 85 connected therewith. Thus, when the spinning frame is restarted after a doff, the time-delay device 84 is energized and the normally open switch 85 is closed for a predetermined time period, for example 15 to 20 minutes, to enable energization of a second time-delayed device 87. In series with the switch 85 is a second switch 88 which is operated in response to the builder cam 34 to close when the builder cam 34 elevates the ring rail to an elevated position relative to the spindle whirl, as described earlier. Thus, when the ring rail is raised a distance above the whirl of the spindle 26, the switch 88 is closed which energizes the time-delay device 87 through the normally closed switch 91 of the time-delay device 87.

Energizing the time-delay device 87 closes the normally open switch 92 of the time-delay device 87 and enables energization of the solenoid 82 through the closed switch 83. Simultaneously, the second switch 91 for the time-delay device 87 is opened to interrupt energization of the device 87. Energization of the time-delayed device 87 latches the device in the open position for a preset time period, for example a time period of 10 minutes which is the time period to permit the carriage 41 of the pneumatic cleaner to complete, at least one full cycle of travel along the track 42. Thus, the time-delay device 87 enables the compressed air to flow through a complete cycle of travel of the carriage 41.

If this cycle of the carriage carries the pneumatic cleaner out of the ring-spinning frame to other sections of the machine, the switch 83 opens to disable the solenoid 82 for that period when the carriage is out of registry with the spinning frame section of the textile machinery. The switch 83 is preferably a toggle-type switch associated with the track 42 so as to be thrown to the open position when the carriage 41 passes out of the spinning frame suction and is returned to the closed position when the carriage 41 returns to the spinning frame section thereby enabling flow of compressed air through the valve 77 and thereby through the nozzles 71 when the carriage 41 is traveling in the spinning frame section of the machinery. If the cleaning apparatus is confined to apparatus consisting of a single spinning frame, the switch 83 may be omitted so that the solenoid 82 is energized or deactivated independently by the switch 92.

As described, it is apparent that the nozzles 71 of the apparatus are in operation for the preset time period determined by the timing device 87 which normally corresponds to the time for a complete cycle of the cleaning device carriage along the track 42. After the preset time period has lapsed, for example ten minutes, the time-delay device 87 opens the switch 92 and deenergizes the solenoid 82 and closes the valve 77 disabling flow of compressed air to the carriage 41 and the nozzles 71. As the time lapse following the elevation of the ring rail to a position above the whirl plus the preset time period provided by the time-delays 87 is normally greater than the predetermined time period of the time-delay device 84, the time-delay device 84 has cycled to its normally open position preventing reactivation of the time-delay device 87 until after the switch 81 has been cycled through the open position back to the closed position. Therefore, even if the builder cam closes the switch 88 several times during the spinning cycle, the whirl cleaning operation will only be initiated once throughout the entire operation, and this once will occur only when the frame is started after the next doff.

Thus, the present invention enables the spinning frame to operate using a standard source of compressed air in the mill without wasting the flow of compressed air inasmuch as it is used only once during each spinning cycle. Furthermore, if the device is attached to a multi-section machine, the compressed air flows only during the time when the cleaning device is traversing the spinning frame section of the machine.

While a particular embodiment of the present invention has been herein illustrated and described, it is not intended to limit the invention to such disclosure but changes and modifications may be made therein and thereto within the scope of the following claims.

We claim:

1. In a textile-machine cleaning device adapted to travel along the length of a textile machine having a series of yarn-handling stations which comprise a rotary spindle adapted to releasably mount a bobbin, a yarn-handling device having a guide element adapted to orbit the bobbin and to traverse the length of the bobbin to effect winding of yarn on the bobbin as the bobbin is rotated by the spindle, said spindle having a whirl in the form of a circumferential surface adjacent one end of the bobbin and adapted to receive turns of the yarns at the conclusion of the winding of the yarn on a full bobbin and before initiating the winding of the yarn on an empty bobbin;

said cleaning device comprising track means extending along the entire length of the textile machine, a carriage mounted for travel along said track means, said carriage including drive means for causing said carriage to traval along the length of the textile machine, suction/exhaust means to generate an outward flow of cleaning air and an inward flow of vacuum air, and filter means to entrap and collect any particulate material from the inward flow of vacuum air, exhaust and vacuum tubes carried by said carriage, said exhaust tubes having exhaust ports directing exhaust air toward the machine in spaces requiring a flow of cleaning air, and said vacuum tubes having inlet ports to draw air and particulate matter from spaces adjacent the machine where particulate matter may accumulate, a central power supply for said drive means and suction/exhaust means having a junction box positioned adjacent said track means, and a flexible energy chain interconnecting said junction box with said carriage, said energy chain having power conduits therein to provide power connections between said junction box and said drive means and said suction/exhaust means in said carriage throughout the travel of said carriage along the length of the track means, the improvement comprising means to strip the turns of yarn from the whirl of each of said spindles, said means comprising whirl cleaner blades corresponding in number to said stations, each blade being movably mounted on the textile machine adjacent one of the spindles and having a free end adapted to be displaced into engagement with the whirl off the associated spindle, the free end being designed and constructed to engage the whirl so as to strip the turns of yarn from around said whirl, means to effect said displacement of said blade ends comprising a nozzle supported on said carriage for travel along the length of the textile machine, said nozzle being positioned to sequentially register with each blade and discharge a jet of air against each blade in a direction to effect said displacement of said blade end into engagement with the whirl as the carriage travels along the length of the textile machine, a conduit means connecting said nozzle to said junction box through said carriage and said energy chain, means in said junction box to supply compressed air for causing a flow of compressed air from said junction box through said conduit and said nozzle, and control means for said air flow effective to enable air flow through said nozzle for a desired time period while said nozzle passes into and out of registry with said blades in the course of the travel of the nozzle along the length of the machine.

2. A cleaning device according to claim 1 wherein each whirl cleaner blade is normally biased away from said whirl of the associated spindle and is displaced against said bias when said nozzle passes into registry with said blade, whereby upon travel of said nozzle out of registry with said blade, the blade disengages said whirl.

3. A cleaning device according to claim 2 wherein said whirl cleaner blade is pivotally mounted adjacent said spindle below said whirl and has its free end projecting upwardly substantially parallel to the rotary axis of said spindle and terminating at the level of said whirl, the pivotal axis of said blade being positioned so that the weight of the blade provides a gravity bias tending to pivot the blade away from the whirl, but affording said displacement of the blade end into engagement therewith.

4. A cleaning device according to claim 1 wherein the textile machine has at least one rail mounting the yarn-handling devices of the entire series of stations for reciprocation at predetermined rate relative to the speed of rotation of the spindles to build a desired package shape on the bobbin, and, after conclusion of the building of the package, to offset the yarn-handling devices to produce wraps of the yarn around the whirls of the spindles, said control means interrupting the air flow through said conduit during offsetting of the devices and activating the air flow through said conduit a preset interval following initiation of said reciprocation, said activation being continued for a length of time greater than the time required for the cleaning device to travel past all of the stations in the series.

5. A cleaning device according to claim 4 for a textile machine having a first section with rotary spindles and a second section without rotary spindles, said device having a track continuing through both sections, wherein said control means includes means to disable said activated air flow when said carriage travels out of said first section into said second section and to enable said activated air flow when said carriage travels out of said second section into said first section.

6. A cleaning device according to claim 5 wherein said enabling and disabling means comprises a sensor responsive to the position of the carriage along said track.

7. A cleaning device according to claim 4 wherein said control means comprises valve devices in said junction box to control the flow of air from said compressed-air supply means.

8. A cleaning device according to claim 4 wherein said activating and interrupting control means comprises an actuator device responsive to the position of the yarn-handling device along the length of the bobbin.

9. A cleaning device according to claim 8 wherein said control means includes a first timing device to afford activation of said air flow by said actuator device no longer than a preset time after initiating the winding of the yarn on an empty bobbin, and a second timing device to interrupt the air flow a selected time after the activation of the air flow.

10. A device according to claim 9 for a textile machine in which said spindles are stopped upon conclusion of the winding of the yarn to enable doffing of the full bobbins and replacement with empty bobbins, and is restarted upon completion of said doffing, said first timing device being responsive to the restarting of the machine to afford activation of said air flow during said preset time after said restarting, said activation by said actuator device being effected when said yarn handling device is elevated above said whirl within said preset time period.

* * * * *